US005120273A

United States Patent [19]

Lin

[11] Patent Number: 5,120,273

[45] Date of Patent: Jun. 9, 1992

[54] VENTILATION PANE ASSEMBLY

[76] Inventor: Jyh-Shyung Lin, 6, Ta Chung N. Rd., Wu Chieh Hsiang, Ilan County, Taiwan

[21] Appl. No.: 760,943

[22] Filed: Sep. 17, 1991

[51] Int. Cl.[5] ..... F24F 13/18

[52] U.S. Cl. ..... 454/195; 454/212; 454/277

[58] Field of Search ..... 454/195, 212, 224, 274, 454/277

[56] References Cited

U.S. PATENT DOCUMENTS

| | | | |
|---|---|---|---|
| 487,163 | 11/1892 | Stagg et al. | 454/195 X |
| 998,421 | 7/1911 | Stein | 454/212 |
| 1,860,648 | 5/1932 | Bokan | 454/195 X |
| 1,939,312 | 12/1933 | Murray | 454/195 |
| 2,308,262 | 1/1943 | Beil | 454/195 X |
| 2,328,761 | 9/1943 | Wamnes et al. | 454/195 |
| 2,579,099 | 12/1951 | Sherry | 454/224 X |

*Primary Examiner*—Harold Joyce
*Attorney, Agent, or Firm*—Bacon & Thomas

[57] ABSTRACT

A ventilation pane assembly for making a panel door or window, comprising two hollowed face panels at two opposite sides, an intermediate frame at the middle, a fixed perforated panel fixedly set between said intermediate frame and one of said two hollowed face panels, and at least one movable perforated panel movable set between said intermediate frame and the other hollowed face panel. Moving the movable perforated panel in one direction causes the vent holes thereon to be aligned with the vent holes on the fixed perforated panel for ventilation; moving the movable perforated panel in the other direction causes the vent holes thereon to be deviated from the vent holes on the fixed perforated panel so that air current is stopped from passing through the ventilation pane assembly.

2 Claims, 3 Drawing Sheets

VENTILATION PANE ASSEMBLY

BACKGROUND OF THE INVENTION

The present invention relates to a ventilation pane assembly and relates more particularly to such a ventilation pane assembly for making a panel door or window which can be conveniently adjusted to let air current pass therethrough or stop it from passing therethrough.

In population-intensive area, high-raised buildings are closely built up together so as to fully utilize the limited, precious land. When various buildings are closely set together, the ventilation of fresh air current may be affected. More particularly, people tend to tightly close the doors or windows so as to secure one completely privacy in one's room or house. When the doors and windows of a house are completely closed, the internal air quality inside a house will be deteriorated. It is harmful to one's health to constantly stay in a blocked space.

SUMMARY OF THE INVENTION

The present invention has been accomplished to eliminate the aforesaid problem. It is therefore an object of the present invention to provide a ventilation pane assembly for a panel door or window which can be conveniently adjusted to let air pass therethrough for ventilation. It is another object of the present invention to provide a ventilation pane assembly for a panel door or window which can be conveniently adjusted to stop air from passing therethrough when an indoor air conditioner is under operation. It is still another object of the present invention to provide a ventilation pane assembly for a panel door or window which can be conveniently adjusted to let air pass therethrough while securing one completely privacy in a house.

According to the present invention, there is provided a ventilation pane assembly for a panel door or window which is generally comprised of two hollowed face panels at two opposite sides, an intermediate frame at the middle, a fixed perforated panel fixedly set between said intermediate frame and one of said two hollowed face panels, and at least one movable perforated panel movable set between said intermediate frame and the other hollowed face panel. Moving the movable perforated panel in one direction causes the vent holes thereon to be aligned with the vent holes on the fixed perforated panel for ventilation. When the movable perforated panel is moved in an opposed direction, the vent holes on the movable perforated panel will be deviated from the vent holes on the fixed perforated panel so that air current is stopped from passing through the ventilation pane assembly.

DETAILED DESCRIPTION OF THE PREFERRED EMBODIMENT

Figure 1:
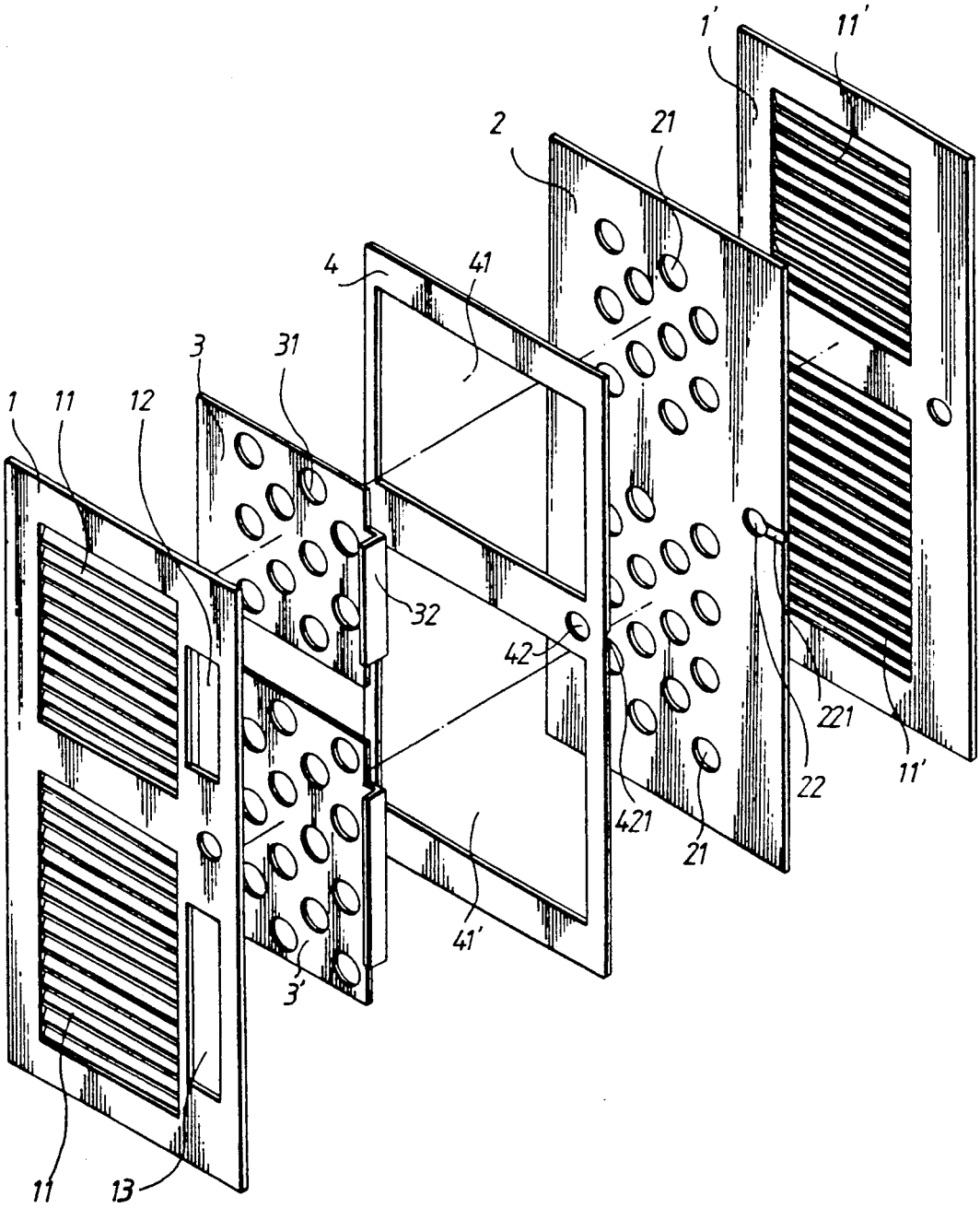
FIG. 1 is an exploded perspective view of the preferred embodiment of the ventilation pane assembly of the present invention.

Referring to FIG. 1, therein illustrated is the preferred embodiment of the ventilation pane assembly of the present invention which is generally comprised of two opposite face panels 1, 1', a fixed perforated panel 2, at least one movable perforated panel 3, and an intermediate frame 4. Each face panel 1 or 1' is formed of horizontal slats 11 or 11' that can be adjusted to regulate the air coming between them. The fixed perforated panel 2 is made from a flat sheet of board having a plurality of vent holes 21 thereon for the passing therethrough of air current. The number of movable perforated panel 3 is determined according to actual requirement. In the present preferred embodiment, there are provided two movable perforated panels 3, 3' longitudinally alinged, each of which has a plurality of vent holes 31 thereon and a side strip 32 at one side at right angle, which side strip 32 serves as a handle for the grip of the hand. The intermediate frame 4 defines therein at least one opening. In the present preferred embodiment, the intermediate frame defines therein two openings 41, 41' for mounting the two movable perforated panels 3, 3' permitting them to be alternatively moved up and down within a fixed range.

Figure 2:
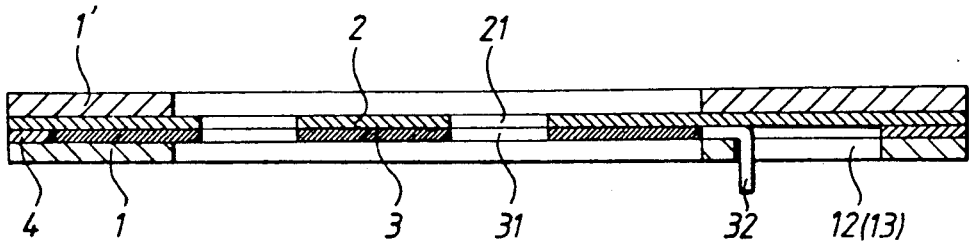
FIG. 2 is a cross sectional view thereof taken in transverse direction (under ventilation mode)
Figure 3:
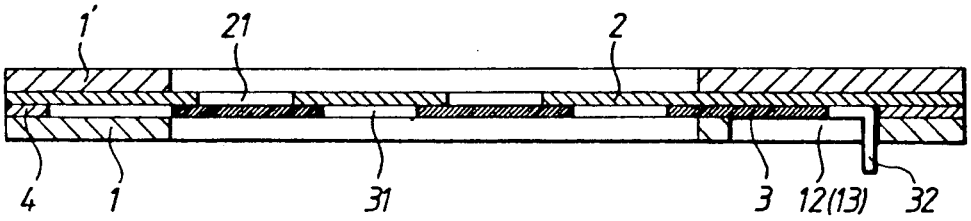
FIG. 3 is a cross sectional view thereof taken in transverse direction (under shut-off mode)
Figure 4:
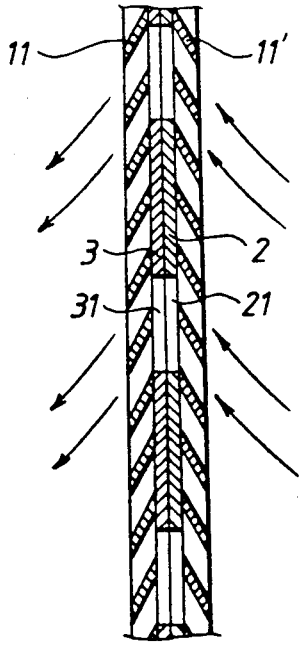
FIG. 4 is a cross sectional view thereof taken in longitudinal direction (under ventilation mode)
Figure 5:
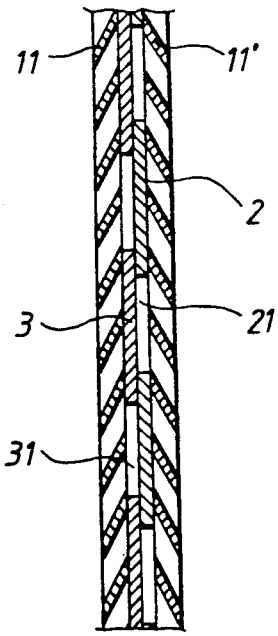
FIG. 5 is a cross sectional view thereof taken in longitudinal direction (under shut-off mode)

The two face panels 1, 1' are attached together to firmly retain the fixed perforated panel 2, the movable perforated panels 3, 3', and the intermediate frame 4 therebetween with the intermediate frame 4 squeezed in between the fixed perforated panel 2 and the movable perforated panels 3, 3'. One of the face panel, namely, the first face panel 1 to which the movable perforated panels 3, 3' are attached has two slots 12, 13 longitudinally alinged at one side (the number of slot is determined according to the number of movable perforated panel). When the pane assembly is set up, the side strips 32 of the movable perforated panels 3, 3' are respectively inserted through the slots 12, 13 on the first face panel 1 (see FIGS. 2 and 3). Pulling the side strip 32 up and down, the movable perforated panel 3 (3') is displaced vertically. When the vent holes 31 on the movable perforated panel 3 (3') are respectively aligned with the vent holes 21 on the fixed perforated panel 2 (see FIGS. 2 and 4), air current is permitted to pass through the pane assembly. On the contrary, when the vent holes 31 on the movable perforated panel 3 (3') are not in alignment with the vent holes 21 on the fixed perforated panel 2, the pane assembly is shut-off (see FIGS. 3 and 5), and therefore, air current is prohibited from passing therethrough.

The aforesaid structure may also be used as a ventilation window. When the structure is used in making a panel door, the fixed perforated panel 2 and the intermediate frame 4 are respectively made with a hole 221 or 421 at a suitable location for mounting a lock device, and a groove 221 or 421 extending from said hole 221 or 421 for the sliding therethrough of the lock tongue from said lock device. Further, instead of the horizontal slats, a plurality of vent holes may be made on the face panel 1 or 1' for ventilation purpose.

Figure 6:
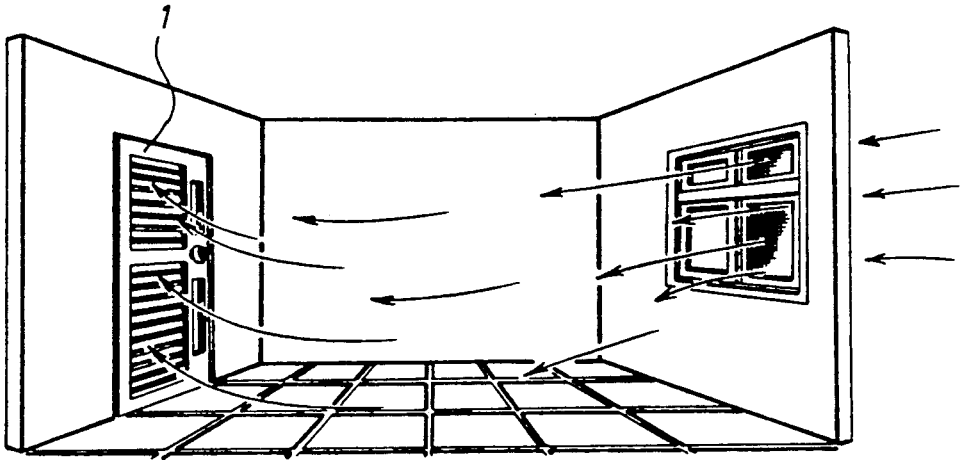
FIG. 6 is a schematic drawing showing an installation example of the present invention and its operation.
Figure 7:
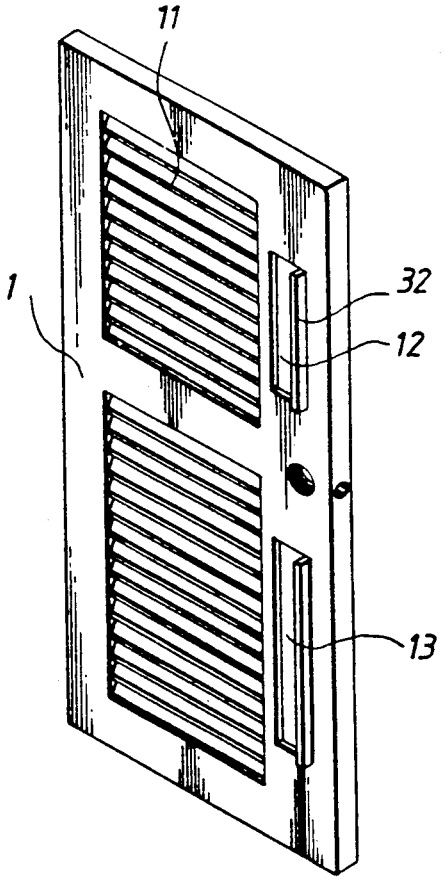
FIG. 7 is an elevational assembly view of the preferred embodiment of the ventilation pane assembly of the present invention.

Referring to FIG. 6, a ventilation panel door or window as constructed in accordance with the present invention can be conveniently adjusted to let air current pass therethrough or shut off to stop air current from passing therethrough. Under ventilation mode, air current is permitted to pass through the ventilation panel door or window while the ventilation panel door or window blocks the inside of the house from been seen.

What is claimed is:

1. For a door or window, a ventilation pane assembly comprising:

two face panels at two opposite sides, said face panels each having a plurality of horizontal slats for the passing therethrough of air current, one of said face panel having a slot at a suitable location;

a fixed perforated panel retained between said two face panels spaced from the one which has a slot thereon, said fixed perforated panel being made from a flat board having a plurality of vent holes thereon;

at least one movable perforated panel retained between said two face panels adjacent to the one which has slot thereon, said at least one movable perforated panel having a plurality of vent holes thereon and a side strip at one side at right angle inserted through said slot;

an intermediate frame retained between said fixed perforated panel and said at least one movable perforated panel, said intermediate frame having at least one opening for mounting each of said at least one movable perforated panel; and wherein moving said side strip causes the vent holes on said at least one movable perforated panel to be respectively aligned with the vent holes on said fixed perforated panel so as to let air current pass through the ventilation pane assembly, or to be deviated from the vent holes on said fixed perforated panel so as to block air current from passing through the ventilation pane assembly.

2. The ventilation pane assembly of claim 1, wherein the intermediate frame has at least one opening for mounting each of said at least movable perforated panel permitting it to be alternatively moved back and forth.

* * * * *